United States Patent [19]

Gibson

[11] 3,930,357

[45] Jan. 6, 1976

[54] RECOVERY OF FILLING YARNS IN A FABRIC WOVEN ON A DOUBLE PICK NEEDLE LOOM

[75] Inventor: Kirkland H. Gibson, North Kingstown, R.I.

[73] Assignee: H. G. P. Corporation, Johnston, R.I.

[22] Filed: Jan. 16, 1975

[21] Appl. No.: 541,528

[52] U.S. Cl. ..... 57/156; 28/72.16; 57/157 R
[51] Int. Cl.[2] ..... D04B 19/00; D02G 3/00
[58] Field of Search ..... 28/72.16; 57/156, 157 R

[56] References Cited

UNITED STATES PATENTS

| | | | |
|---|---|---|---|
| 3,263,410 | 8/1966 | Mansfield et al. | 57/156 |
| 3,605,225 | 9/1971 | Gibson et al. | 28/72.16 |

OTHER PUBLICATIONS

"High-Speed 'Weave-deweave' Process;" p. 63, Modern Textiles; Vol. LV, No. 10; Oct. 1974.

*Primary Examiner*—Louis K. Rimrodt
*Attorney, Agent, or Firm*—Barlow & Barlow

[57] ABSTRACT

Filling yarns are removed from a fabric woven on a double pick needle loom and then packaged on a revolving bobbin for subsequent re-use by interposing a ring and ring traveler through which traveler the yarn is led from the fabric to the bobbin package with a traverse of the yarn parallel to the axis of the bobbin, the traveler serving to compensate for the uneven flow rate of the filling yarn from the woven fabric.

5 Claims, 3 Drawing Figures

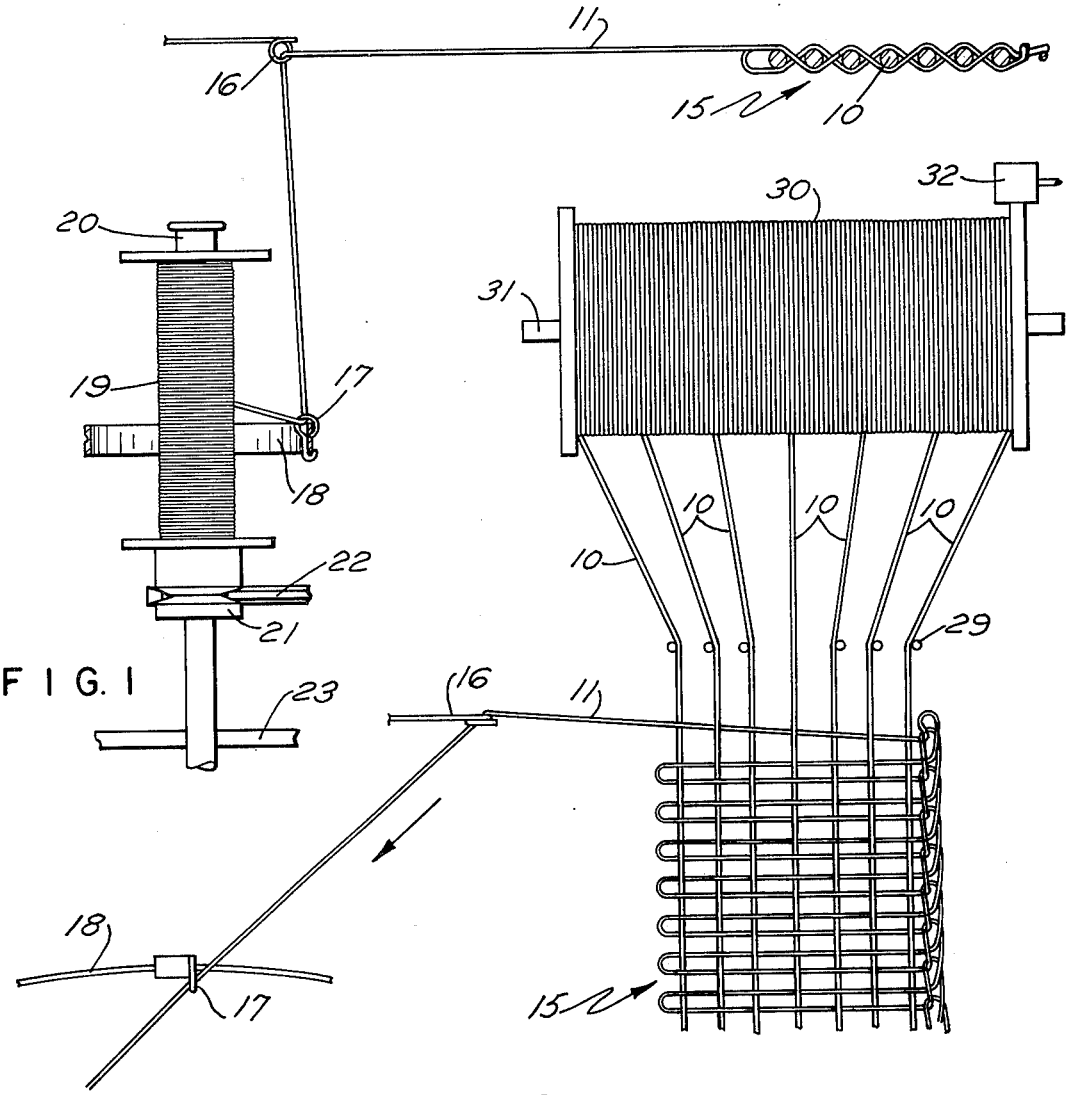
FIG. 1
FIG. 2
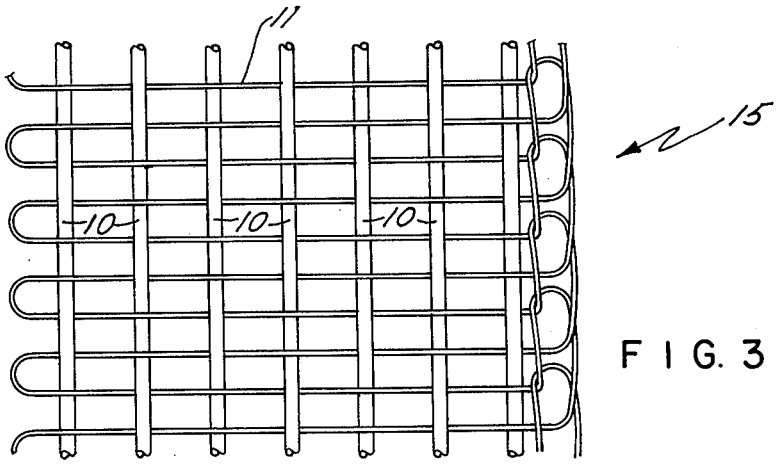
FIG. 3

RECOVERY OF FILLING YARNS IN A FABRIC WOVEN ON A DOUBLE PICK NEEDLE LOOM

BACKGROUND OF THE INVENTION

In the removal of a filling yarn from a woven fabric, such for instance as a fabric woven on a double pick needle loom as shown in U.S. Pat. No. 3,605,225, there is an uneven flow rate of the filling as it is drawn from the fabric. In fact, the filling can become entangled in itself. Heretofore the handling of an uneven flow rate has been done by nip rolls to nip the yarn and control and even out the flow rate of the yarn and thus to even out the tension to the winding means. This does not control self-entanglement. Allowance must be made also for shrinkage of the filling yarns when exposed to elevated temperatures during dyeing, heat set and drying cycles and for bulking of the warp yarns. Further, slip spindle winders have been used, but the slippage of the spindle is not an even tension control and leads to numerous operating problems.

SUMMARY OF THE INVENTION

In this invention it has been found that the filling yarn may be drawn from a woven fabric by guiding the yarn to a ring and traveler which ring encircles a bobbin with a traverse motion for the yarn to wind on the bobbin without the interposing of any nip rolls to grip the yarn and the imposing of an additional control of tension on the yarn. The traveler on the ring which encircles the bobbin serves as a compensator and causes sufficient take-up resiliency and compensation due to the variation of the ballooning of the yarn between the traveler on the ring and a guide of the yarn to the traveler so as to make unnecessary the nip rolls heretofore used for controlling the yarn and its tension between the withdrawal of the yarn from the narrow fabric and the packaging, thus speeding the process and making it economical to re-use the filling yarns in subsequent similar operations.

DESCRIPTION OF THE DRAWINGS

FIG. 1 is a diagrammatic view illustrating in generally side elevation the drawing of the filling yarn from a fabric to a guide, thence to a ring traveler which encircles the packaging bobbin;

FIG. 2 is a diagrammatic top plan view of the parts shown in FIG. 1 and also illustrating the means for taking up or winding the warps which are processed for further use;

FIG. 3 is a plan view of a fabric formed on a double pick needle loom and showing the filling yarn for withdrawal therefrom.

DESCRIPTION OF THE PREFERRED EMBODIMENT

With reference to the drawings, a narrow fabric 15 is formed such as shown in FIG. 3 of the drawing in which there are warp yarns 10 with a finer filling yarn 11 woven therewith on a double pick needle loom in which the filling is passed across the warps doubled on itself and passed back through the warps without a change in the shed on the same side of each warp as it is inserted from a given side, the loops on one side being positioned about a wire from which the fabric is withdrawn, while on the other side the loops are caught with a latch needle, spring needle or hook which is withdrawn. This form of fabric is also shown in FIG. 2 of U.S. Pat. No. 3,605,225.

It is desired that the filling yarn 11 be recovered for subsequent re-use due to the costs of the yarn in the present economy. Referring to FIG. 1, the fabric designated 15 is illustrated with the filling yarn 11 extending therefrom as it is withdrawn from the warp yarns 10 of the fabric. The filling yarn will be suitably guided so as to give a rather long lead between the fabric and a pigtail guide 16 which is located above the package to be formed, and thence is led to a traveler 17 which rotates about a ring 18 which encircles the bobbin 19. This bobbin is mounted on a spindle 20 to which there is secured a whorl 21 with a belt 22 for driving the spindle. As is customary in the art, a spindle is mounted in a rail 23 and the ring moves vertically up and down about the bobbin for traversing the yarn along the bobbin. The warp yarns 10 are lead about guides 29 and packaged on a drum 30 mounted on a shaft 31 and driven in any suitable manner such as by driving of the drum by means of a driven friction roll 32 or any other means. These warp yarns are usually processed for intermittent coloring, bulking or the like and are an intermediate product for the forming of other fabrics as set forth in U.S. Pat. No. 3,605,225. In practicing the process of U.S. Pat. No. 3,605,225, the filling yarns which tied the fabric together were removed and destroyed. However, in the present instance the economics make it desirable to save the filling yarns for re-use in the processing of additional warp yarns.

The filling yarn 11 is drawn from the fabric designated generally 15. The drawing of the filling yarn 11 from the fabric causes an uneven flow of the yarn, possible self-entanglement, and uneven tension. However, it is found that by leading the yarn through a guide 16 and thence through a traveler 17, the speed of the bobbin 19 being in excess of the necessary take-up for winding of the yarn on the bobbin, that the traveler will rotate about the bobbin and put a small amount of twist in the yarn 11, the twist relationship being the difference in speed between the wind on the bobbin and the revolutions of the spindle for winding. The traveler 17 will have to be weighted sufficient so that there will be a drag of the traveler on the ring which will result in the twisting of the yarn to a small extent, and it will be apparent that any change in the flow rate of the yarn 11 will result in a relative change in the twist level in the yarn. A sudden stop would result in the speedup of the traveler putting in higher twists and higher wind resistance of the balloon of the yarn between the traveler 17 and the guide 16, thus increasing the tension of the yarn 11. Such retarding of the yarn flow or sudden stop might result from kinking of the yarn or some knot in the warp catching the yarn as it was being pulled from the fabric. This higher twist and higher tension buildup would thus exert a greater pull on the yarn 11 and would release it from kinking, snarling or catching. This sudden release would then change the balloon on the yarn and result in an increased takeup of the filling on the package and thus balance out this intermittent tension which resulted, allowing the traveler to again slow down and the balloon to even out until a stable condition was again reached. Thus this variation is absorbed by the compensation of the traveler without the need of nip rolls to grip the yarn and control the tension. The formulas which apply to this action are as follows and with an example so as to show how the results are obtained:

winding $\frac{\text{inches/minute recoverable from fabric}}{\text{inches wound/revolution}} = \text{Revolutions/minute required for winding}$ twisting $\frac{\text{traveler revolutions/minute}}{\text{inches/minute}} = \text{turns/inch}$ Example 6000 RPM of spindle
3'' bobbin diameter
1000 ypm available (average)

$$\frac{1000 \text{ yds} \times 36''}{3 \times \pi} = 3819 \text{ RPM (for winding)}$$

$$6000 - 3819 = 2181 \text{ RPM (for twisting)}$$

$$\frac{2181 \text{ RPM (traveler)}}{3600'' \text{ required}} = .0605 \text{ TPI (average)}$$

With a 5 inch bobbin diameter $$\frac{1000 \times 36}{5\pi} = 2291 \text{ RPM (for winding)}$$

$$6000 - 2291 = 3709 \text{ RPM (for twisting)}$$

$$\frac{3709}{36000} = .103 \text{ TPI}$$

The assumed bobbin diameter of 3 inches is at the start of winding, while the assumed bobbin diameter of 5 inches is near the completion of the winding. By this method there is a resiliency and compensation for intermittent supply and tension to overcome any snagging and an evening out of the supply and demand in the packaging of filling yarn for drawing it directly from a woven narrow fabric.

I claim:

1. The method of removing and packaging the filling yarn from a fabric woven on a double pick needle loom and said filling having a change of flow rate as drawn from the fabric comprising, taking up the filling yarn on a bobbin, rotating the bobbin, interposing between the fabric and the bobbin takeup, a ring and traveler through which traveler the yarn extends to the bobbin, guiding the yarn to the traveler and traversing the yarn on the bobbin whereby the traveler serves as a compensator for the change in flow rate of the filling yarn as drawn from the fabric.

2. The method of claim 1 wherein the yarn moves between the point of removal from the fabric and the bobbin takeup free from being gripped and restrained.

3. The method of claim 1 wherein the bobbin is rotating faster than the winding rate of the yarn therein.

4. The method of claim 1 wherein the bobbin is rotating faster than the winding rate of the yarn thereon and the revolutions beyond the winding rate results in twist of the yarn.

5. The method of claim 1 wherein the yarn balloons between the traveler and the guide of the yarn thereto.

* * * * *